United States Patent [19]

Smejda

[11] Patent Number: 4,984,439

[45] Date of Patent: Jan. 15, 1991

[54] DISCONTINUOUS, EXPANDABLE MODULAR PROCESSING FOR FIBROUS MATERIALS AND SHEETINGS IN PLASTIC, PAPER AND METALS

[76] Inventor: Richard K. Smejda, P.O. Box 344, Paterson, N.J. 07544

[21] Appl. No.: 780,953

[22] Filed: Oct. 28, 1985

[51] Int. Cl.[5] ..... D06B 3/10

[52] U.S. Cl. ..... 68/5 C; 68/5 D; 68/8; 118/68; 72/38; 34/236

[58] Field of Search ..... 68/5 R, 5 B, 5 C, 5 D, 68/8, 9, 10; 8/149.2, 149.3, 154, 155, 155.2; 162/207, 375; 34/24, 236; 72/38; 118/65, 68, 67

[56] References Cited

U.S. PATENT DOCUMENTS

| | | | |
|---|---|---|---|
| 1,287,543 | 12/1918 | Wilkinson | 8/154 |
| 4,070,877 | 1/1978 | Fleissner | 68/5 D |
| 4,494,389 | 1/1985 | Smejda | 68/5 C |

FOREIGN PATENT DOCUMENTS 45-28744 9/1970 Japan .

*Primary Examiner*—Harvey C. Hornsby
*Assistant Examiner*—Frankie L. Stinson

[57] ABSTRACT

A discontinuous system applies chemical solutions, dispersions, slurries and pastes to fibrous materials, paper, plastic and metal sheeting, or their composites, confined in one station and capable to wind, rewind and position rolls in sequence and to process sheeting with the ability to interrupt, inspect sections, and add additional windings of the same roll under varied conditions.

10 Claims, 5 Drawing Sheets

DISCONTINUOUS, EXPANDABLE MODULAR PROCESSING FOR FIBROUS MATERIALS AND SHEETINGS IN PLASTIC, PAPER AND METALS

BACKGROUND OF THE INVENTION

1. Field of the Invention

This invention relates to a modular unit for discontinous processing of fibrous materials, paper, plastics and metals in hostile environments of temperature, corrosion, and toxicity and leading into the new technology of "percolation through solid matrices", and its expansion into continuous operations.

2. Prior Art

One system incorporating similar principles has been patented to this inventor under U.S. Pat. No. 4 494 389 as a fully continuous system, however commercial success has been prevented by an unfamiliar technology combined with extensive cost for a commercial beginning.

This improvement shows a modular unit using a discontinuous operation to install the centerpiece described under "rewinding" in the U.S. Pat. No. 4 494 389 and prove the new technology of processing under "phase-transition" at the boil for a fraction of the cost of a continuous range. As a fully operational discontinuous unit this system can be operated as sampler for production lots and for regular dyeing and processing. As the training of staff and personnel advances this module can be complemented by adding two or more additions and arriving at a completely continuous processing range.

SUMMARY OF THE INVENTION

It is therefore the object of this invention to combine efficiency with simplicity and economy of initial investment not available in the prior art and adding the ability to advance from a small discontinuous production system to a very advanced wet-processing range with the help of knowledge and earnings gained from this modest start.

The next object is to provide a sampling unit with the ability to interrupt and check individual lots for the progress of chemical reactions and to provide discontinuous operations of higher universality, better reactivity and more efficiency than customary systems. Its versatility permits to teach dyeing and processing under "phase transition at the boil" under close observation and direct control.

Another object is the division of processing operations into the task of three or more modules capable to be added individually for a homogeneous growth of the capacity.

It is another object to provide instrumentation and controlled systems capable to operate in hostile environments without manual handling.

The next object is to concentrate all energy dispensation within the fully insulated chamber combining direct and indirect heating of the substrates with the heating of the chamber and its structure plus the internal generation cf operating steam from the waste of energy inherent to the primary heating system, the result is expected to be an energy efficiency above ninety percent.

These objects are achieved in principal by combining all fundamental functions in module 1 thereby creating a discontinuous basic unit operating for the first time on all temperature levels from cold to "percolation through solid matrices". This percolation is created by the constant vaporization of hot spots within the roll of fabrics (solid matrix) and bubbling its way through fibers, yarns and layers to the outside, transferring energy, recondensing and arousing other bubbles somewhere else, but generally vaporizing dyestuff-liquor within the roll, imparting energy and lowering gradually the moisture content within the roll. The fact that all internal molecules having reached the energy of vaporization depart means that the roll is kept at a steady 100° C. as long as substantial amounts of moisture are present. It is the most effective and most stable temperature level ever tapped for textile dyeing operations and this is the first time it is used in discontinuous operations.

Other objects and advantages will become apparent from the following description in conjunction with the accompanying drawings.

DESCRIPTION OF THE PREFERRED EMBODIMENT

In the patent cited above this inventor has established three working sections for fabric processing: chemical applications, rewinding and heating, and dwelling. All under conditions of multiple temperatures including the new area of "percolation through solid matrices". With different applicators for solutions, dispersions, slurries and pastes the variety and universality of variable treatments is very large. Another drawback of the previous art is the inability to access goods in process for intermediate checking during the process. The simplicity of lowering the two rolls in process individually or combined for inspection, interruption, or discontinuation of operation at any time is of paramount importance for testing, processing of the first lot of a series, or for alteration of variables. The ability to inject different vapors, different sprays, or to rewind the roll a second or third time or even more at will provides a flexibility not given in the continuous operation. It is therefore of the utmost importance that the same unit can operate in identical performance with the discontinuous system and also if so desired can be incorporated within a continuous range as module.

Figure 1:
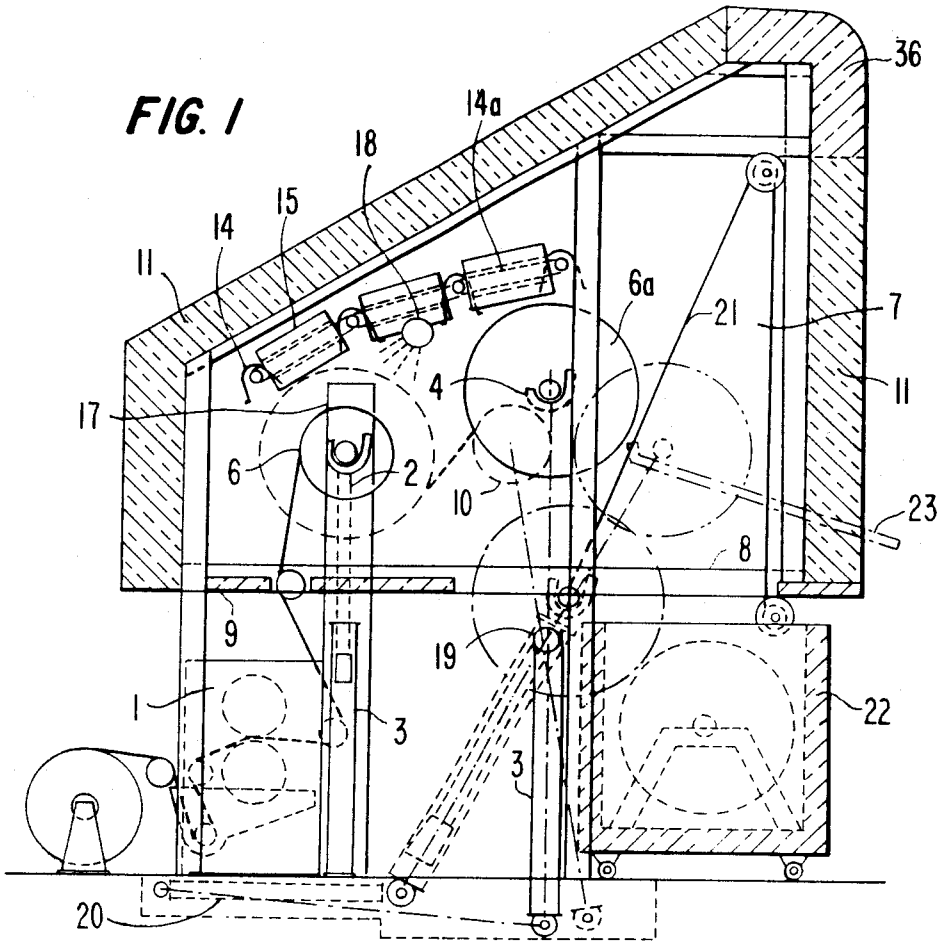
FIG. 1 shows a schematic sideview of the center module with lifting, transfer and heating.

It is a simple matter to use the center section of rewinding add an applicator to the take-off side and supply enclosed housing and heating together with means to remove the rewound roll after allowing the proper time for reaction and development. All this is shown in FIG. 1 incorporating the centerpiece 25 of FIG. 2 as independant operating unit when combined with applicator 1, which in this illustration is indicated as a padder for dyes and chemicals in solutions, dispersions or slurries. The winding mechanism 2 doubles as reststation until the end of roll 6 is connected to the shell or core 5 on the rewinding position 10 and the rewinding is started. The chamber 7 housing the roll after winding and rewinding is heavily insulated at 11 to guard against loss of energy. It is filled with steam at atmospheric pressure but higher than 100° C. to prevent condensation within the chamber and to preserve the rolls at boiling temperature while confined within the chamber. Whenever cooler temperature than 100° C. are used the angled roof provides run-off of condensation towards the lower side and will be assisted in places by absorbant coverings. An overflow pipe (not shown) provides for exhaust of excess steam within chamber 7 reaching the lower border line at section 8. Below 8 a selection of solid and transparent panels 9 closes the bottom of the chamber to permit access as needed but prevent intrusion or admixture of ambient air by draft or turbulence. Hydraulic cylinders 3 position the rolls in two pairs at suitable distance to each other and to the heating system 14*a* as controlled by double-acting solenoid valves, or any other system such as winches or screw drives capable to position loads at desired locations. As shown in FIG. 3 the driving mechanism is raised together with the hydraulic shaft 3, while the cores or shells 5 sit in the brackets 4. The driving shaft 12 driven by motor 12*a* acts over an angular gear reducer and gear 2 on gear 13, which is firmly attached to the shaft controlling the cores 5. The major advantage is the removal of all drives and motors from the corrosive environment of the chamber 7, be it with extensions of shafts to the exterior or with chains, sprockets or racks. It is very important to provide all mechanisms required to permit maintenance or repair without complete shut-down of operations by proper location of sensitive parts and equipment.

Each pair of hydraulic cylinders 3 crosses at will into the chamber 7 positioned either automatically or by operator assistance. The operator. is able to start connections, or interrupt, terminate, or sample one or both roll positions by lowering the hydraulic shafts to the lowest position underneath the steam/air line of separation 8. The outside will hardly cool off and will quickly come up to boiling again after return to the superheated steam environment. The entire roll of many layers is controlled at boiling temperature by some energy input, but mainly by the superheated steam preventing the surface of the roll from cooling off.

One rewinding of a roll to achieve boiling, internal vaporization and percolation through solid matrices, is usually sufficient but for purposes of checking and testing, additional windings may be programmed, and vapors or liquid sprays are distributed from openings 18 to provide additional reactions or chemical changes as desired.

Figure 4A:
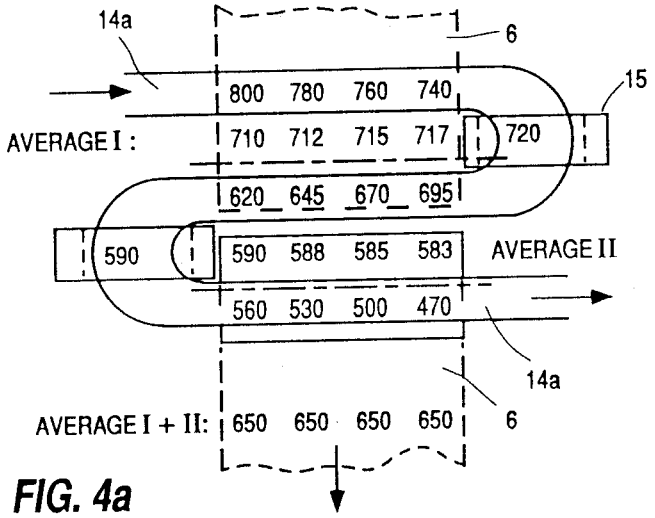
FIG. 4*a* describes a temperature drop within the infrared piping and its influence on the conformity of heating to specifications.
Figure 4B:
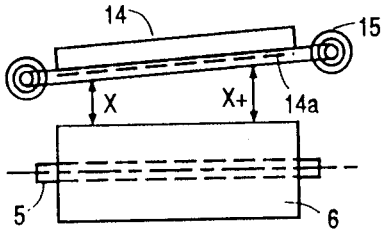
FIG. 4*b* shows a tilting action of the heat pipes to achieve uniform heating.

More savings of energy are achieved by carrying a long gas, or oil flame through a convoluted piping radiating infrared energy towards the layers of substrates, the rolls and the structures, as well as generating and superheating all the process steam used. The FIGS. 4*a* and 4*b* show such a piping system and its heat distribution. The flame starts at a burner under pressure and is pushed into the pipe together with the correct amount of air and oxygen, a suction generator at the other end of the pipe extends the length of the flame. As well known the heat diminishes over the number of serpentines, which could lead to uneven heating over the width of the substrates. To prevent this improper effect at least two legs are provided for each roll, or each major exposure of a substrate with average I and II in FIG. 4*a* demonstrating a leveling of incident radiation; a combination of both averages could provide a complete level over three legs of this system. However to counteract any differences in heating of the substrates from side to side means are provided to lift the pipes away from the substrate at the hot spots or bring it closer at the cooler area; x−x+.

Movable parabolic reflectors shown in FIG. 1 14 permit to direct the radiation towards the goods or toward structures as required by processing. Sleeves 15 at the turns neutralize heating from the selvage of the rolls to prevent overdrying or overheating, while carrying within these sleeves a trickle of boiling water to be transformed into superheated steam. This is in addition to the steam emanating from the boiling rolls. It is mostly sufficient to permit operation without boilers.

Figure 3B:
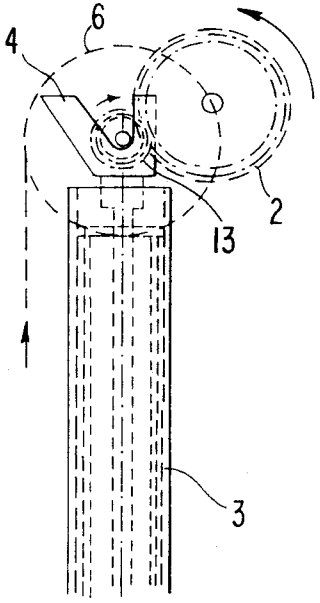
FIG. 3*b* is a schematic side view of cylinder, bracket and gear.
Figure 3A:
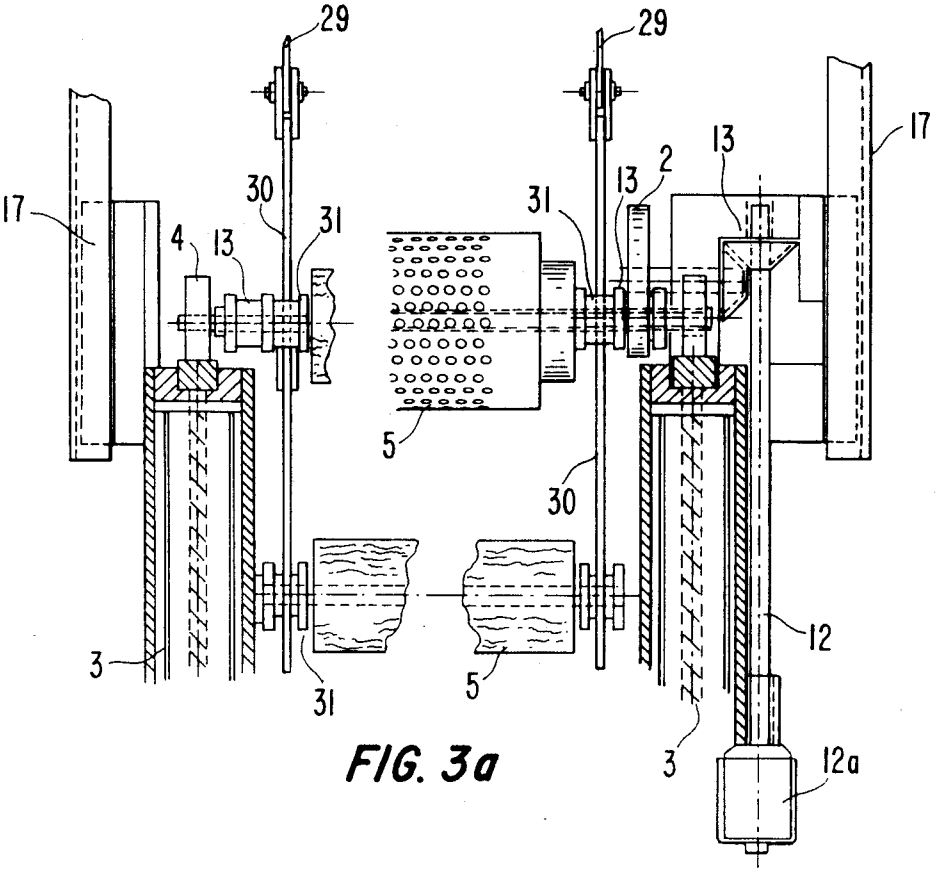
FIG. 3*a* illustrates a schematic front view of the lifting and driving system.

To adjust the proximity between two rolls of substrates or for offloading one or both sets of hydraulics 3 may be set-up for tilting as shown in FIG. 1, with journal 19 providing a fulcrum for the tilting actuator 20 which in this case is illustrated as a cylinder, but may be a screw or a rack and gear. In FIGS. 1 and 3*a* a guidance frame 17 relieves the hydraulic cylinder 3 from any angular forces exerted by tilting, pull or push on the extended shaft of the hydraulics, it also acts as safety mechanism.

After rewinding the roll 6 stays for the prescribed time within the chamber 7 to complete the desired reactions, after completion of this stage it is directed to insulated storage, to hold, or to bench. The next roll 6 can immediately advance to the rewind position.

On take-off the nearly completed reaction is finalized by removing it with the winch 21 from the bracket 4 and releasing it into the brackets of the storage container 22, well insulated, or heated, and covered by an insulated top. The boiling roll will give off enough heat to provide very slow cooling within the box. Low-cost processing is guaranteed. The winch and/or the tilting mechanism also performs off-loading to the rack 23 serving as link to the conveyor 24, if and when the discontinuous system in FIG. 1 is incorporated as centerpiece 25 into the continuous range of FIG. 2. The applicator 1 is advanced from the centerpiece 25 to the new addition of the winder 26 to complete the continuous range.

Since a number of discontinuous dyeing machines such as jiggers, dyebecks, jet-dyeing and beam-dyeing do not provide savings comparable to this invention they could be used as boil-off and washing ranges in the same position as the washing compartments 27. A padder combined with the storage 28 will be used for desizing and cold bleaching. With this method it is possible to convert gradually a traditional dye-house into a very modern textile wet-processing organization.

Figure 2:
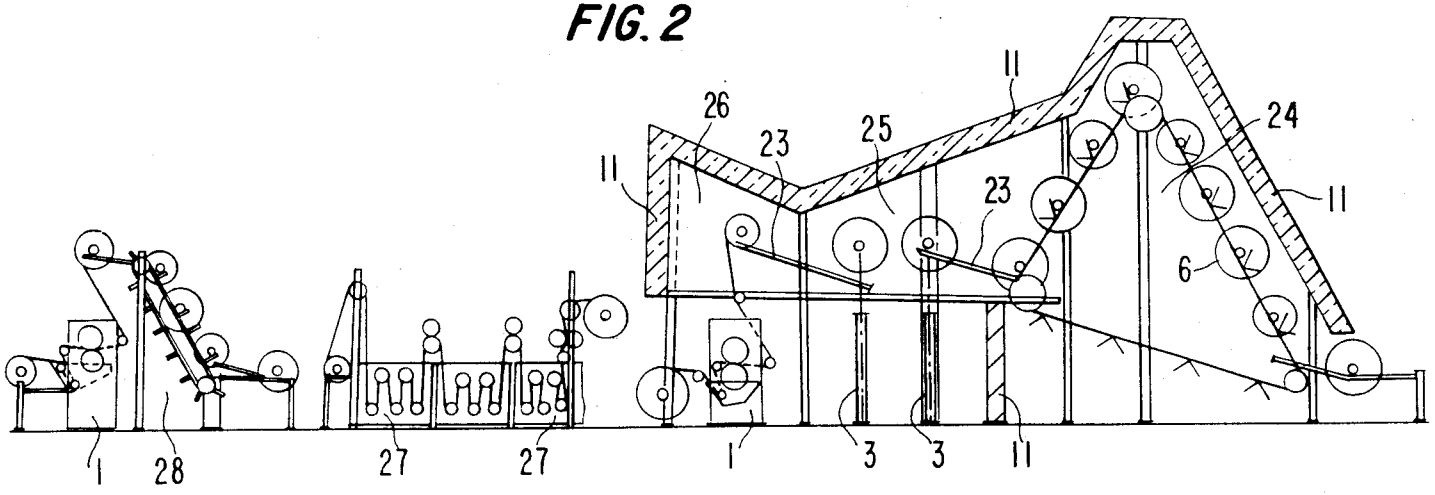
FIG. 2 is a schematic sideview of the preparation and processing range with the module of FIG. 1 depicted in center position 25.
Figure 6:
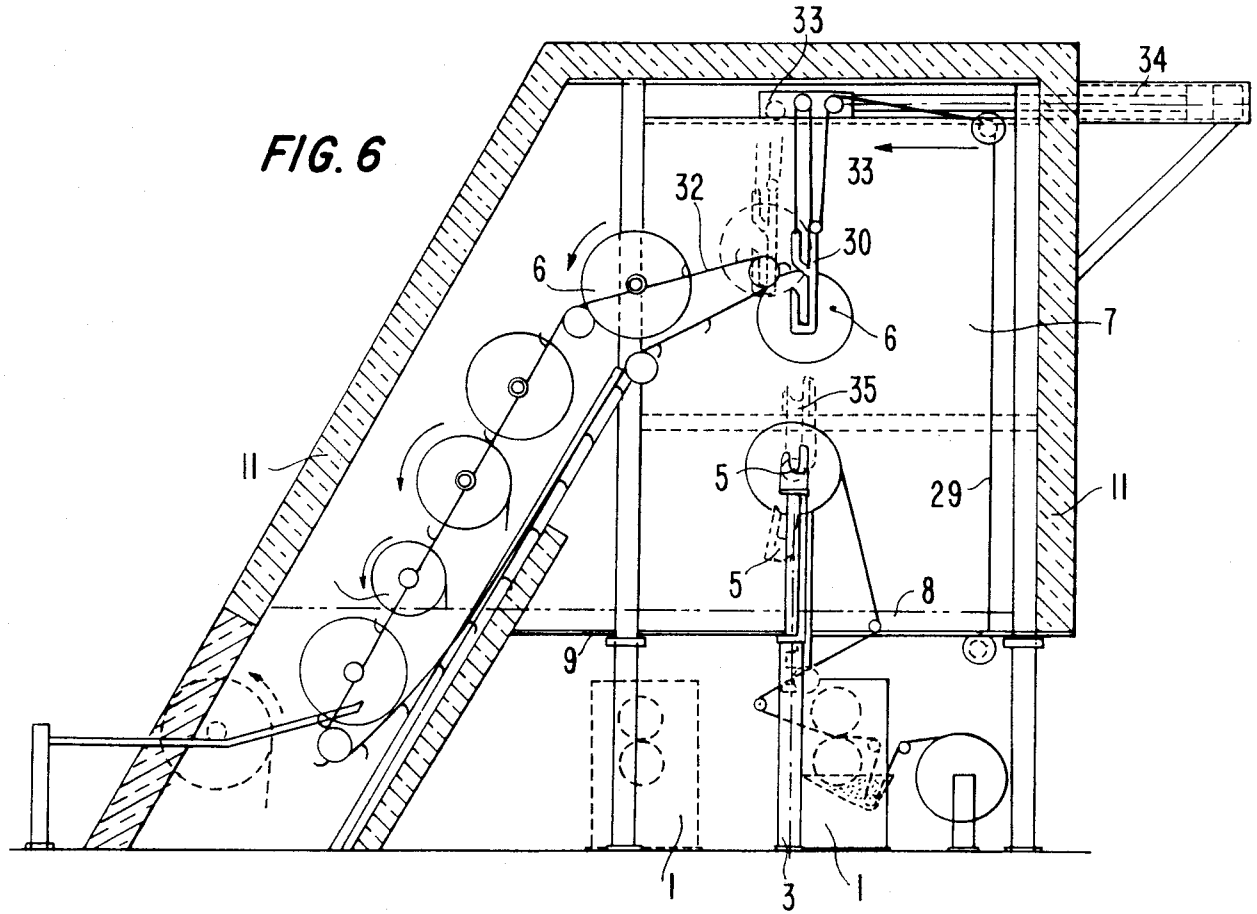
FIG. 6 is a schematic view of the vertically operating module on the right and the added conveyor system on the left.

For simplicity of control and diversity of operation the FIGS. 1 and 2 refer to horizontal transfer of the roll 6 at the rewinding position FIG. 6 explains another transfer mechanism using vertical movement in a combination of hydraulic push 3 and the pull by winch 29 connecting to two cores 5 with the double hook 30. In FIG. 3*a* the upper receptacle of hook 30 engages the bearing 31 on core 5 loosely as it sits in the two brackets 4 on top of the cylinders 3 to be driven for winding fabrics or sheeting coming from the applicator 1. In the lower receptacle of hook 30 another core 5 waits in reserve to be used for rewinding. To wind from the applicator 1 the cylinders 3 are raised to any temperature zone available and designated for any particular substrate.

After completion of the primary winding the winch 32 raises the two parallel hooks 30 either by means of a dual cable drum or by means of a connector bar acting on two cables, one from each hook.

Figure 7:
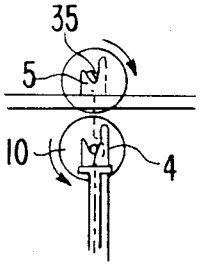
FIG. 7 is a schematic view of the rewinding process.

The winch takes care of the transportation along the y-axis, while the carriage 33 takes care of the x-axis, moving forward and back, activated by the cylinder 34 or a suitable screw arrangement. Both axes in combination permit to position the roll 6 in the two rewinding brackets 35 connected to one or two brakes and if desired to a DC-motor for the fine tuning of tension between the let-off and rewinding drives. As the roll 6 is lowered into the brackets 35 it engages with the clutch on the shaft extending from brake and/or motor located outside the chamber 7 in ambient air with the shaft breaching the insulation. The clutch is selflocking and opened by a mechanical push, or, engaged by the vector of the pull of the substrate being wound and pushed into the bracket by the gear 2 conveying the driving force (in FIG. 3*b*). FIG. 7 illustrates the rewinding operation in about midway.

Before moving up from primary winding the outer end of the substrate is wound around the lower core 5 in the lower receptacle of the hooks 30 to establish the connection. After the loaded upper core 5 has been deposited in the brackets 35 the two cylinders 3 are raised to engage the lower core 5 at a suitable distance from roll 6. The hooks 30 may be lowered with the lower core since the upper core and roll 6 are already firmly deposited in the brackets 35. The roll 6 is now wound from the upper position 35 to the brackets 4 on the cylinders 3 using the same motor drive as in the first winding. It may stay there until full reaction of all parameters has been achieved or it is lowered as before into the insulated box 22 shown in FIG. 1. The transfer is accomplished by the winch 29, hooks 30 and carriage 33.

This description of the vertical center module is designed to be augmented by the conveyor system in FIG. 2 or in FIG. 6. In both instances the transfer will be accomplished over a pair of inclined racks 23, or directly by the x/y- mechanism to the conveyor. Once deposited on the conveyor 32 the hook 30 will slide out through its opening on the left simply by lowering the hook 30 by releasing the pull of winch 29. The upper core 5 is now empty and by further lowering the cable on hook 30 will return to the winding position 10 for a new processing operation. A second applicator 1 can be added for a second rewind application.

Another improvement compared to commercial insulation of industrial ovens or steamchambers is the use of heavy composite insulation without the customary all-around metal skin acting as bridge between interior heat and ambient temperature by conduction and convection.

Figure 5:
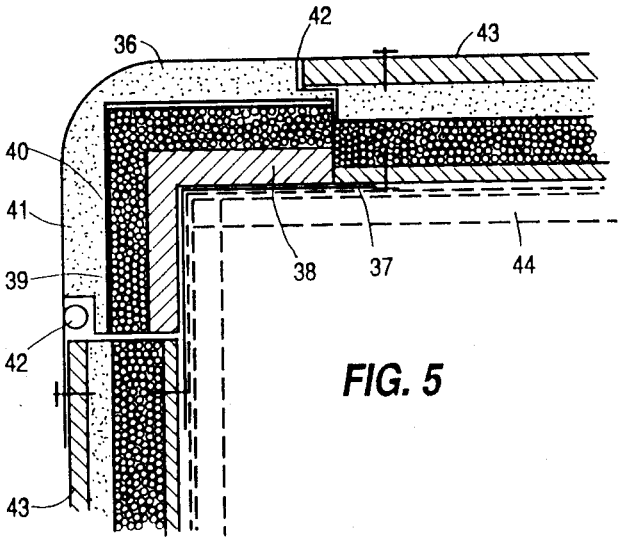
FIG. 5 is a schematic cross-section through a composite of insulating panels.

FIG. 5 shows the composition and construction of corner sections to be filled in by a selection of flat panels and sheets suitable for the various areas encountered and connected with the corner panels 36 with the inner flaps 37 of corrosionproof and heatresistant material such as stainless steel sheeting, which also serves as reflecting material for the rebounding infrared radiation within the chamber. Next to the steel sheeting is heatresistant fibrous matting usually of fiberglass or ceramic fibers 38, followed by poured porous foam of very coarse structure using for example polyester foam 39, encased by a protective barrier of plastic or metal sheeting 40, with an outer section of poured foam filling the space to the outer casing, which is plastic sheeting of fireproof material, smooth and washable. The entire housing is between 20 and 30 cmm thick to assure prevention of heat loss. The outer foam 41 has one indentation 42 on each side to accomodate electrical lines, steam pipes or the like and to serve as support for the rigid outer panels 43 filling the flat spaces between corners. Otherwise the flat spaces show a similar composition in the choice and thickness of materials as the corners. Great pain is taken to avoid gaps and bridges capable of conducting interior heat to the outside. Perfect insulation not only protects the energy level inside but also guards against improper condensation within interior structures, indicated by angular steel 44.

Special importance must be attached to instrumentation and datafiles. The characteristic of a semicontinuous or continuous operation is its inabilityto accept additions and corrections of recipes and formulations during the development process. In order to arrive at stable, repeatable performance from one execution of a specific order to the next repeat order it is necessary to repeat not only the chemical compositions but also all conditions relevant to the optimal quality of the finished goods. For this reason the following parameters are cited for best performance under the conditions of this invention: Substrate; textile fabrics of all types.

(A)
- Dimensions 1; length and widths of grey goods
- Dimensions 2; length and width of boiled and bleached goods
- Dimensions 3, length and width of processed goods.

(B) Padding or Application:
1. Weight after boil-off.
2. Formulation of applicator liquid.
3. Temperature of applicator liquor.
4. Moisture monitoring during application.
6. Padder tension on goods processed.
7. Weight of roll after application.

(C) Rewinding of Roll:
8. Monitoring of the temperature of the substrate during winding, i.e. IR-Pyrometer.
9. Rewinding speed, rewinding total time.
10. Rewinding tension.
11. Weight of roll after rewinding.

(D) Box storage or Bench:
12. Weight after reaction time in chamber
13. time in development, storage, or hold.
14. Weight and temperature at end of hold.

Similar parameters apply to the processing of paper, plastic and metal sheeting depending on a large variety of end-uses.

While only a limited number of embodiments have been illustrated and described, it is apparent that many other variations may be made without departing from the scope of the invention as set forth in the appended claim.

What I claim is:

1. A system for processing endless materials through a plurality of applicators, winders, resetters, rewinders and storage locations, wherein the improvement comprises:

a working area;

a discontinuous modular machine located adjacent said working area for the processing of substrates including fibers, sheeting and batches of cellulosic and synthetic materials, plastics and metal foils in a hostile environment, including a chamber supported overhead and generally closed on all sides, top and bottom, said chamber having a narrow opening slotted at the bottom of said chamber to enter said substrates from said working area, said opening being closed to prevent air from entering said chamber and preventing excess vapors escaping from said chamber to enable said vapors to condense on said substrates as they enter said chamber whereby said condensed vapors are returned to said chamber as condensate on said substrates; means at said working area to feed and process said substrates including two dual working stations, each working station equipped with drive means and brake means, to start, brake and stop, wind forward and wind back any number of times; additional means to lift and lower said substrates, move said substrates forward and back and to interchange all available options to maneuver said substrates along the x,y-axis of the machine, and means to open the bottom and sides of said chamber to permit the entry and removal of said fibers, sheeting, and batches of cellulosic and synthetic materials, plastics and metal foils.

2. The system of claim 1 further including prime movers, brakes and energy generators located outside of said chamber, means connected between said prime movers, brakes and energy generators and said chamber to control the motion of said substrates in said chamber.

3. The system of claim 2 including means connected to said prime movers, brakes and energy generators to tilt and direct said substrates to predetermined locations, said tilting and directing means including angular distortion protection means.

4. The system of claim 1 including means located in said chamber for applying dispersions, slurries and solutions to said substrates, and means located in said chamber to manipulate said substrates in at least one winding, in forward and reverse directions, said manipulating means including dual lifting devices for positioning said substrates.

5. The system of claim 1 further including means in said chamber for energizing said substrates to a state of internal vaporization and to maintain said substrates at reversible phase-transition between liquid and vapor by subjecting said substrates to super heated steam and vapors; energy generating means mounted in said chamber to assist the maintenance of said substrates at said state by subjecting said substrates to said energy source.

6. The system of claim 1, further including winding and heat generating means mounted in said chamber for winding and applying heat evenly over the width and length of said substrates during winding; movable means coupled to said winding and heat generating means to reflect direct and indirect radiation on to the substrates; means mounted in said chamber to control the temperature of said substrates and the temperature of the interior of the chamber said temperature control means including a heater including means to generate an elongated flame, a length of serpentine tubing, and means to apply said flame to said tubing to use said tubing to radiate energy.

7. The system of claim 1, further including means mounted in said chamber to inject sprays or gases under controlled conditions towards said substrates.

8. The system of claim 1, wherein said chamber includes composite insulation mounted thereon; reflective sheeting mounted at the interior thereof; and fire resistant materials mounted on the outside of said chamber including heat resistant insulators.

9. The system of claim 1, further including means to permit said system to operate continuously including at least one applicator, a rewinding station, and storage means including a moving conveyor for storing and transporting said substrates.

10. The system of claim 9, further including instrumentation means connected to said system for monitoring, controlling and data recording for the reliable control of repeat performance in the processing of said substrates, including means to measure the dimensions of substrates before, during and after processing, recording the formulation used, weigh said substrates, monitor and control temperatures, moisture content, processing speed, tension, pressure and time sequences.

* * * * *